US009335136B1

(12) United States Patent
Campbell

(10) Patent No.: US 9,335,136 B1
(45) Date of Patent: May 10, 2016

(54) ARROW DISPENSING DEVICE AND LUBRICATED ARROW

(71) Applicant: Michael L Campbell, Flagstaff, AZ (US)

(72) Inventor: Michael L Campbell, Flagstaff, AZ (US)

(73) Assignee: Slick Hunting Products Inc., Flagstaff, AZ (US)

( * ) Notice: Subject to any disclaimer, the term of this patent is extended or adjusted under 35 U.S.C. 154(b) by 0 days.

(21) Appl. No.: 14/285,583

(22) Filed: May 22, 2014

Related U.S. Application Data

(60) Provisional application No. 61/826,465, filed on May 22, 2013.

(51) Int. Cl.
*F42B 6/04* (2006.01)
*F42B 12/36* (2006.01)

(52) U.S. Cl.
CPC ..... *F42B 12/362* (2013.01); *F42B 6/04* (2013.01)

(58) Field of Classification Search
CPC ..... F42B 6/04; F42B 6/08
See application file for complete search history.

(56) References Cited

U.S. PATENT DOCUMENTS

| | | | | |
|---|---|---|---|---|
| 3,066,940 | A | 1/1960 | De Lonais | |
| 3,565,435 | A | 2/1971 | Bear | |
| 3,572,716 | A | 3/1971 | Bear et al. | |
| 3,893,866 | A | 7/1975 | Hollingsworth | |
| 4,463,953 | A | 8/1984 | Jordan | |
| 4,806,430 | A * | 2/1989 | Spielvogel | A61L 29/085 206/571 |
| 5,183,259 | A | 2/1993 | Lyon | |
| 5,295,692 | A * | 3/1994 | Wright | F42B 6/04 473/578 |
| 5,445,243 | A | 8/1995 | Coffey et al. | |
| 6,093,685 | A | 7/2000 | Wood, Sr. | |
| 7,615,249 | B1 | 11/2009 | Kudwa | |
| 2004/0077441 | A1 | 4/2004 | Derus et al. | |
| 2006/0189420 | A1 | 8/2006 | Hunt | |

* cited by examiner

*Primary Examiner* — John Ricci

(74) *Attorney, Agent, or Firm* — Invention to Patent Services; Alex Hobson

(57) ABSTRACT

An arrow device having a frangible reservoir for dispensing lubricants and/or tracking material, and an arrow comprising a lubricant or tracking material is described. A frangible reservoir may have an enclosure comprising frangible material that can be ripped, punctured, torn, burst or otherwise compromised to release the contents therein. A frangible reservoir may be configured as part of an arrow shaft, arrowhead, or a dispensing device and may include a cavity therein. A frangible seal may be configured over a portion of the reservoir, such as a release port. A frangible reservoir may be configured to rupture when the arrow that it is attached to is shot from a bow, or enters an object. A rupture element may be configured with a frangible reservoir or dispensing device to rupture or open the frangible reservoir.

7 Claims, 15 Drawing Sheets

ARROW DISPENSING DEVICE AND LUBRICATED ARROW

CROSS REFERENCE TO RELATED APPLICATIONS

This application claims the benefit of U.S. provisional patent application No. 61/826,465, filed on May 22, 2013 and entitled Arrow Dispensing Device and Lubricated Arrow; the entirety of which is incorporated by reference herein.

BACKGROUND OF THE INVENTION

1. Field of the Invention

The present invention relates to an arrow device comprising a frangible reservoir for the dispensing of lubricants and/or tracking material, and an arrow comprising a lubricant or tracking material.

2. Background

Archers, and particularly bow hunters, take steps to ensure that their arrows are configured properly for the type of bow and energy imparted to the arrow when shot. The type and weight of the arrowhead are variables a bow hunter considers before going out on a hunt. A bow hunter wants to have effective penetration of the arrow into the game, and the speed and energy of the arrow play an important role. An arrow may not effectively penetrate an animal in some cases and leave the animal wounded, sometimes critically. Animals will run off after being hit and may run for miles before collapsing, leaving the hunter with the difficult challenge of tracking and finding the animal. It is desirable to have deeper penetration of an arrow into an animal, thereby increasing the likelihood of dropping the animal in close proximity to where it was struck by the arrow.

When an animal does not drop near the location that they are struck by an arrow, a hunter has to track the animal. Often times, a hunter is looking for drops of blood, but this can be sporadic and limited, with only one drop every couple of meters, or less. In addition, often times the ground, such as leaves and snow, make it even more difficult to track the animal. As many animals are more active early in the morning or in the evening, tracking a wounded animal can often be required in dark or low light conditions; making it even more difficult to find the scarce drop of blood. An implement that improves or provides a more discernible trail for wounded animal tracking would be very useful to hunters.

SUMMARY OF THE INVENTION

The invention is directed to an arrow device comprising a frangible reservoir for dispensing lubricants and/or tracking material, and an arrow comprising a lubricant or tracking material. A frangible reservoir may comprise an enclosure having an outer layer, or portion of an outer layer that can be ripped, punctured, torn, burst or otherwise compromised to release the contents therein. A frangible reservoir may be an enclosure consisting of a frangible enclosure material, much like a paint-ball. In other embodiments, a frangible enclosure may be a reservoir with a frangible seal over a portion of the reservoir. A frangible reservoir may be configured to rupture when shot from a bow, or upon entry into an object, such as an animal. The inertia of shooting the arrow, or of the arrow hitting an object, may initiate the rupture of the frangible reservoir. A frangible enclosure may comprise a film that can be easily burst, or punctured for example. The reservoir may comprise a lubricant and/or a tracking material, as further described herein.

A lubricant may be any suitable lubricant including, but not limited to, silicone, hydrocarbon fluids and oils, natural oils, synthetic lubricants, hydrogels and the like. A lubricant may be configured within a lubricant reservoir, or in some cases, it may be coated directly onto a portion of the arrow, including at least a portion of the arrow shaft, and/or a portion of the arrowhead, for example. In an exemplary embodiment, a lubricant is a transition lubricant, whereby it is dry to the touch and has a first coefficient of friction in the dry state that is much higher than when the lubricant has effectively come in contact with animal fluids, including blood. The second coefficient of friction, or coefficient of friction after contact with animal fluids, may be much less than the first coefficient of friction, such as one half or less, one quarter or less, one fifth or less, or one tenth or less. A transition lubricant coated onto an arrow shaft enables an archer to manipulate the arrow without slipperiness contaminating their fingers and hands, which may make it very difficult, if not dangerous, to load and shoot the arrow. A dry coating of a transition lubricant on an arrow shaft, that is not slippery or does not substantially come off with general handling, would be very useful in hunting. In addition, a coating of a lubricant on the outer surface of an arrow shaft may also reduce drag during flight and/or reduce sound as the arrow travels through the air.

A transition lubricant may be a hydrogel type lubricant that is a network of polymer chains that are hydrophilic and can be dried, and in some cases either cross-linked or configured into an interpenetrating network, whereby the lubricant forms coatings on surfaces. This dried hydrogel transition lubricant may become very slippery when exposed to water or other liquids, such as animal fluids including blood. Hydrogels may comprise any suitable type of polymer including silicone, poly(vinyl alcohol) PVA, polyurethanes, fluoropolymers, and the like. A lubricant coating on an arrow may have any suitable thickness and may be coated onto any portion of the arrow, including the arrow shaft, the arrowhead and the fletches. In an exemplary embodiment, substantially the entire outer portion of the arrow shaft length is coated with a transition lubricant, excluding the length where the fletches are configured. In another exemplary embodiment, an arrowhead is coated with a transition lubricant.

In one embodiment, a layer of low friction material is coated onto the shaft of the arrow, such as a low friction polymer. Low friction polymers, including fluoropolymers and parylene, or poly(p-xylylene) polymers, may be coated, or otherwise applied, on the outer surface of an arrow shaft to reduce friction. In one embodiment, a thermal shrink tube may be shrunk down over a portion of the shaft. For example, a fluorinated-ethylene-propylene (FEP) or polytetrafluoroethylene (PTFE) shrink tube may be attached to a portion of the shaft. In another embodiment, a low friction layer of material may be wrapped, such as by cigarette wrapping or spiral wrapping onto a shaft. In still another embodiment, a low friction layer may be applied through chemical vapor deposition, such as poly(p-xylylene) polymers. The low friction layers may be applied in such a way that it has ridges that run along the length of the shaft that reduce the outer surface area of the shaft, thereby reducing drag upon entry into an object or game animal. In still another embodiment, ridges may be spiral around the shaft and this spiral configuration of ridges may enhance or improve flight and/or reduce drag upon entry into an object. The thickness of a shrink tube or other coating may be any suitable thickness. However, a thin layer to reduce weight may be preferred. For example, the thickness of a shrink-tube or wrapped low friction layer may be no more than about 100 um, no more than about 50 um, no more than about 25 um and any range between and including the thickness values provided. In the case of a chemical deposited low friction material, the thickness may be no more than about 10 um, no more than about 5 um, no more than about 2 um, no more than about 1 um, and any range between and including the thickness values provided. The combination of a low friction layer and a dispensed or applied lubricant may provide superior penetration results. A low friction material, such as a fluoropolymer, may be etched to allow a lubricant to spread more uniformly over the surface. For example, a fluoropolymer type low friction material may have at least one surface plasma etched to improve lubricant wetting.

A frangible reservoir may comprise a tracking material, such as a material that fluoresces, under any suitable type of light. In one embodiment, the tracking material is a glow-in-the-dark material providing a hunter a clear marker to track an animal in dark conditions. In another embodiment, the tracking material fluoresces when a UV or black light is cast on it. These types of fluorescing materials, known as flourophores, emit either visible or invisible light when irradiated with a shorter wavelength, including ultraviolet rays, black lights, and X-rays. For example, a hunter using an arrow comprising a tracking material dispensing device may shine a UV or black light to find small traces of this material. Fluorescing materials include, but are not limited to, Vitamin A, and B, thiamine, niacin, and riboflavin, whiteners such as those used in detergents, and the like. A frangible reservoir, comprising a tracking material, may be configured to rupture when shot from the bow, or upon entry into an object, such as an animal. The tracking reservoir may be configured to dispense the tracking material substantially completely upon entry, or may be configured to release the tracking material more slowly, whereby it is dispensed from the arrow over time, thereby more effectively providing a trail to follow. In some cases, the tracking reservoir may be configured to release the tracking material from the end of the arrow shaft, or fletch end of the arrow, where it may more likely be extending out from a wounded animal.

A frangible reservoir may be coupled to any suitable portion of an arrow including the arrow shaft, arrowhead or fletches. A frangible reservoir maybe configured as a disc, cylinder, ball, toroid or any other suitable shape. In exemplary embodiments, a frangible reservoir is configured with an opening therethrough whereby it can be slid over an arrow shaft, a portion of the arrowhead, or a threaded portion, for example. In an exemplary embodiment, a frangible reservoir has an opening that may be slid over the arrowhead end of the arrow shaft and seated against the arrowhead. When the arrow hits an object, the frangible reservoir, comprising a lubricant, is ripped open and lubricant is dispensed along the arrow shaft, thereby reducing friction and increasing penetration of the arrow into the object. In another embodiment, a frangible reservoir may be slid over a male thread portion of arrowhead which, upon attachment of the arrowhead to the arrow shaft, configures the frangible reservoirs between the arrowhead and the shaft. The frangible reservoir may have an outer diameter, and the outer diameter may preferably be larger than the arrow shaft outer diameter, thereby exposing the frangible reservoir to shear upon entry into an object.

A frangible reservoir may be configured with a rupture element that ruptures the frangible reservoir upon shooting the arrow or upon entry into an object. For example, a sharp object, such as a blade or point, may be configured downstream of a frangible reservoir, configured around the arrow shaft, and when the arrow hits an object, the frangible reservoir may be displaced whereby it is punctured or ruptured by the rupture element. Likewise, a rupture element comprising a piercing portion, such as a point or blade, may be configured upstream of the frangible reservoir and upon shooting the arrow or hitting an object, the rupture element may be displaced and pierce, rip or rupture the frangible reservoir, thereby dispensing the contents therefrom.

A frangible reservoir may be configured inside a portion of an arrow shaft, a portion of an arrowhead, or configured inside a lubricating or tracking device, which are collectively referred to herein as a dispensing device. A dispensing device may be coupled to the arrow, such as between the arrowhead and arrow shaft. A dispensing device may have a male threaded portion for coupling with an arrow shaft and a female thread portion for coupling with an arrowhead. In most cases, an arrowhead has a male threaded portion that is screwed into the female threaded insert of an arrow shaft. A dispensing device may be configured to simply couple the arrow head to the arrow shaft.

A dispensing device may comprise a recess along the outer diameter of the dispensing device, whereby a frangible reservoir may be at least partially configured therein, much like an O-ring groove. A recessed outer diameter of a dispensing device allows more volume for the frangible reservoir without increasing the outer diameter of the dispensing device. A dispensing device may comprise any suitable type and configuration of rupture elements. A rupture element may be inside a cavity within a dispensing device or be configured on the outer surface of the dispensing device. A dispensing device may be configured to be reusable, whereby replacement frangible reservoirs may be attached to the dispensing device, or a cavity within the dispensing device may be refilled with a lubricant and/or tracking material, and a frangible seal may be attached over a release port. A rapid expansion chemistry composition may be configured as a rupture element, whereby activation of the rapid expansion chemistry displaces an object, such as a piston or disc that bursts the dispensing reservoir.

A frangible reservoir may be configured at least partially, or entirely, within a cavity of an arrow shaft, arrowhead or dispensing device, whereby the lubricant or tracking material are released through a release port. A release port may comprise a plurality of holes, slits or other openings to allow release of the lubricant and/or tracking fluid. A frangible reservoir may have an enclosure that is made entirely of a frangible material or may comprise only a portion that is frangible. For example, a dispensing device may comprise a frangible reservoir that comprises a cavity within the dispensing device and a seal that is frangible.

In an exemplary embodiment, a frangible reservoir is configured to be ruptured by one or more mechanical arrowhead blades. Mechanical arrowhead blades are configured to move back and out as the arrow enters an object. A frangible reservoir may be configured such that a mechanical blade hits the reservoir and ruptures it. A mechanical blade may be configured with a piercing portion that further enhances or assures the rupture of the frangible reservoir. A frangible reservoir may be configured to hold one or more mechanical blades in place until an object is struck, whereby the mechanical blades are displaced and ruptures the frangible reservoir. A frangible reservoir may have a torrid shape and be configured to hold at least one mechanical blade in a recessed or closed orientation.

A frangible reservoir may be configured to be inserted at least partially into an arrowhead cavity whereby mechanical blades or a mechanical blade insert is configured to rupture the frangible reservoir. A frangible reservoir may be inserted into a cavity within an arrowhead and a mechanical blade insert having a ring portion may be configured to rupture the frangible reservoir upon entry into an object. Release ports in the arrowhead may provide for dispensing of the contents from the frangible reservoir.

In an exemplary embodiment, a frangible reservoir contains only a liquid or liquid solution therein. In one embodiment a combination of lubricant and fluorescent tracking material are contained within the frangible reservoir. In yet another embodiment, only lubricant is contained within the frangible reservoir. In still another embodiment, only a tracking material is contained within the frangible reservoir and the tracking material may be a fluorescent material.

An arrowhead may comprise a plurality of mechanical blades and a plurality of fixed blades. The combination of blades may be configured in any suitable orientation around the perimeter of the arrowhead. A common orientation of three blades is a 120 degree offset around the perimeter. Three fixed blades may be configured at 120 degree offset from one another around the perimeter of the arrowhead and three mechanical blades may be configured between the three fixed blades, thereby providing a blade every 60 degrees around the arrowhead perimeter. Likewise, two fixed blades may be configured across from each other, or with a 180 degree offset, and two mechanical blades may also be configured across from each other at a 90 degree offset from the mechanical blades.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
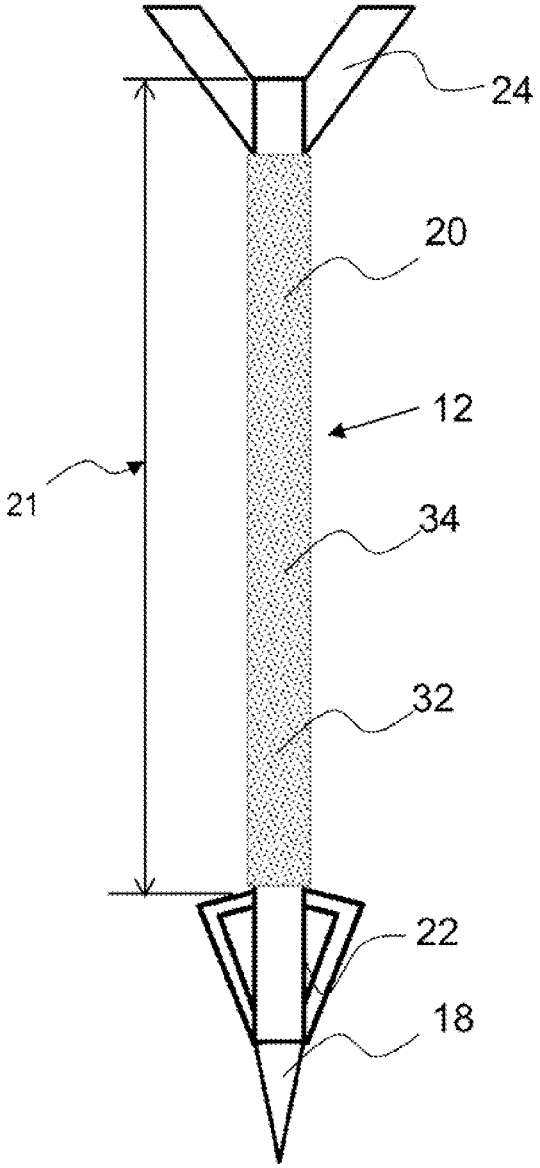

FIG. 1 shows a side view of an exemplary arrow comprising a lubricant coating on the arrow shaft.

Figure 2:
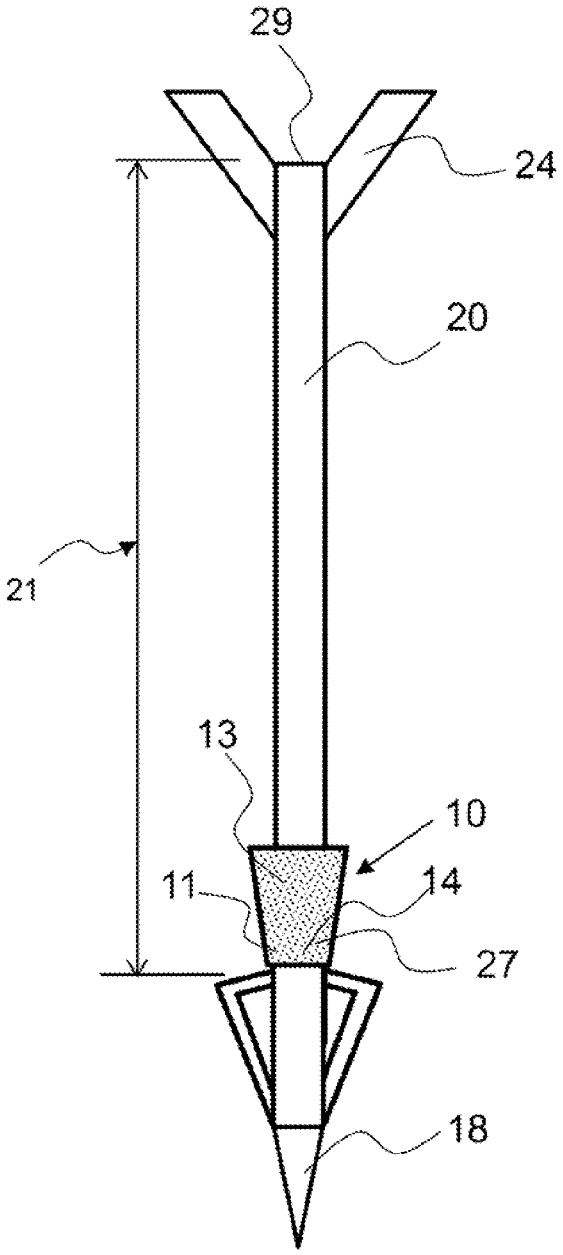

FIG. 2 shows a side view of an exemplary frangible reservoir configured on an arrow shaft.

Figure 3A:
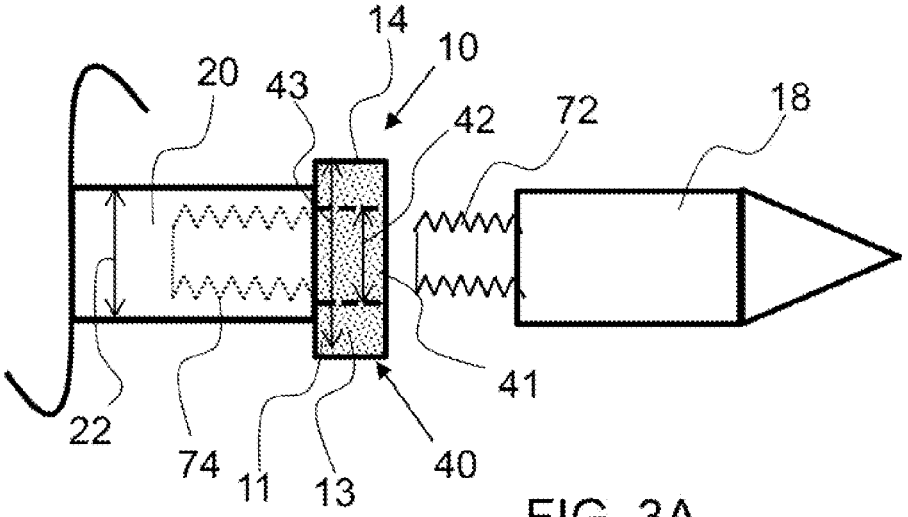
Figure 3B:
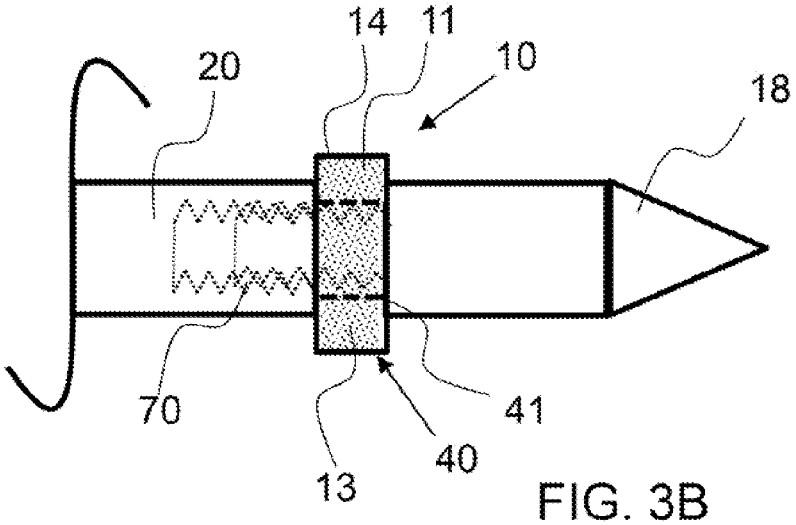

FIGS. 3A and 3B show side views of an exemplary frangible reservoir configured between an arrow shaft and an arrowhead.

Figure 4:
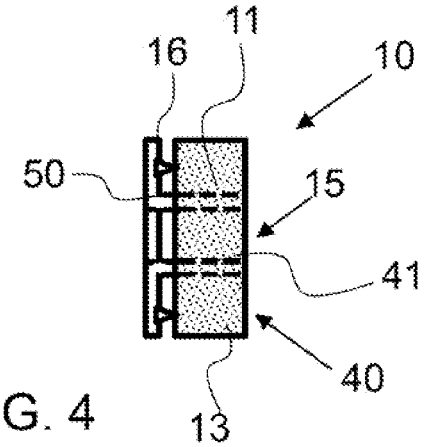

FIG. 4 shows a side view of an exemplary dispensing device comprising an frangible reservoir and rupture element.

Figure 5:
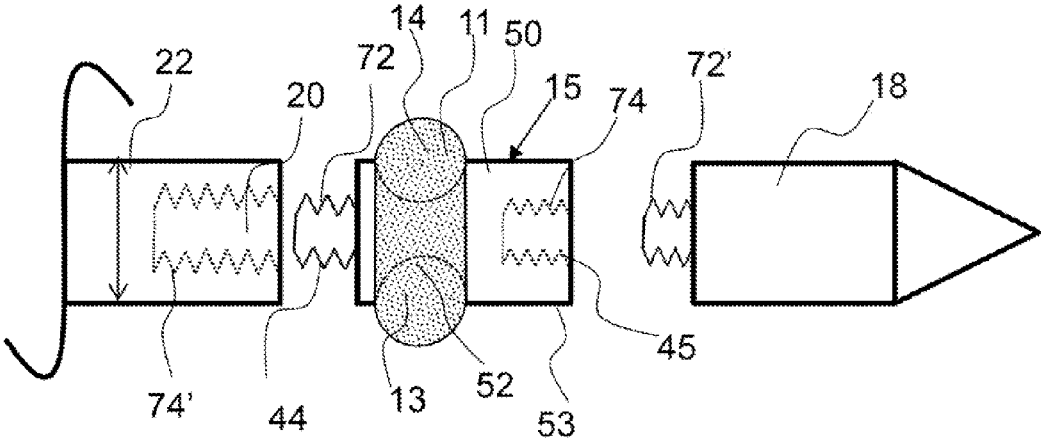

FIG. 5 shows a side view of an exemplary dispensing device comprising a frangible reservoir configured in a recess of a dispenser body.

Figure 6:
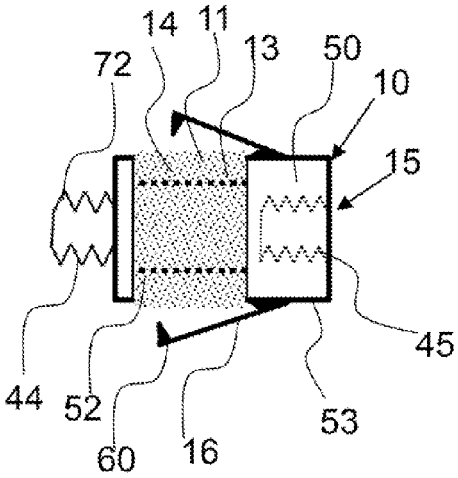

FIG. 6 shows a side view of an exemplary dispensing device comprising a frangible reservoir configured around a dispenser body and exemplary rupture elements.

Figure 7:
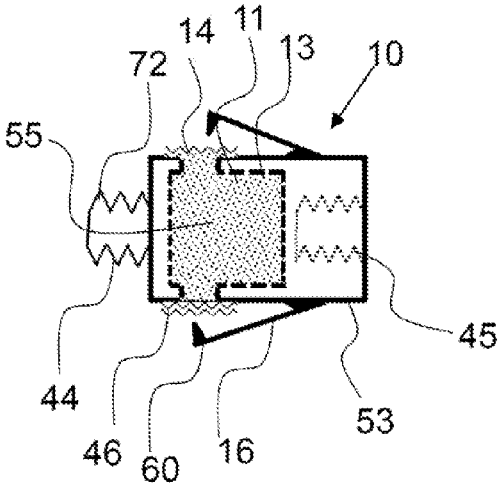

FIG. 7 shows a side view of an exemplary dispensing device comprising a frangible reservoir within a cavity of the dispenser body and exemplary rupture elements having piercing portions configured over a reservoir seal.

Figure 8A:
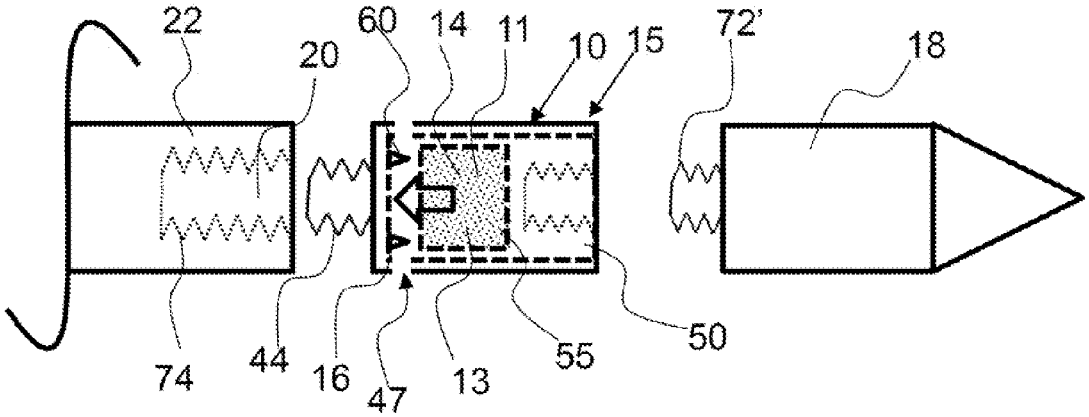

FIG. 8A shows a side view of an exemplary dispensing device comprising a frangible reservoir within a cavity and a rupture element within the same cavity.

Figure 8B:
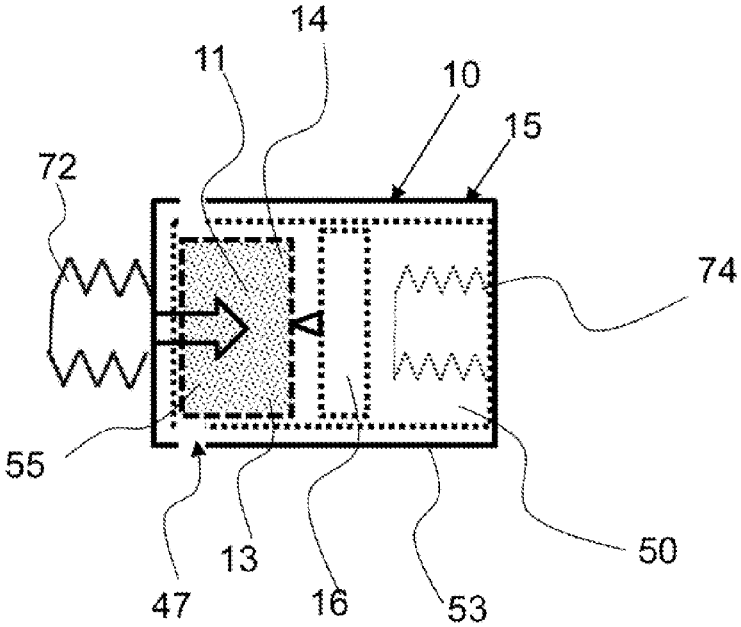

FIG. 8B shows a side view of an exemplary dispensing device comprising a frangible reservoir within a cavity and a rupture element within the same cavity.

Figure 9A:
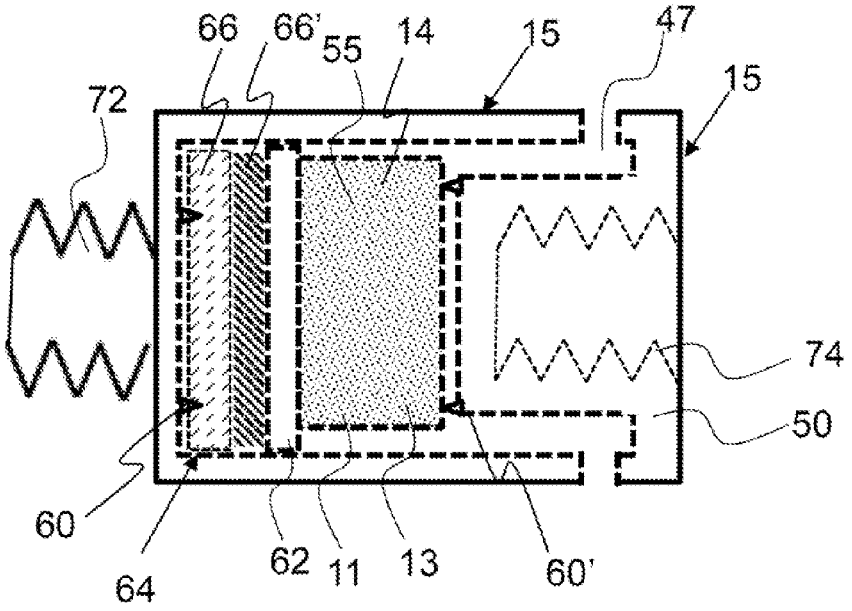

FIG. 9A shows a side view of an exemplary dispensing device comprising a frangible reservoir within a cavity and a rapid expansion type rupture element within the same cavity.

Figure 9B:
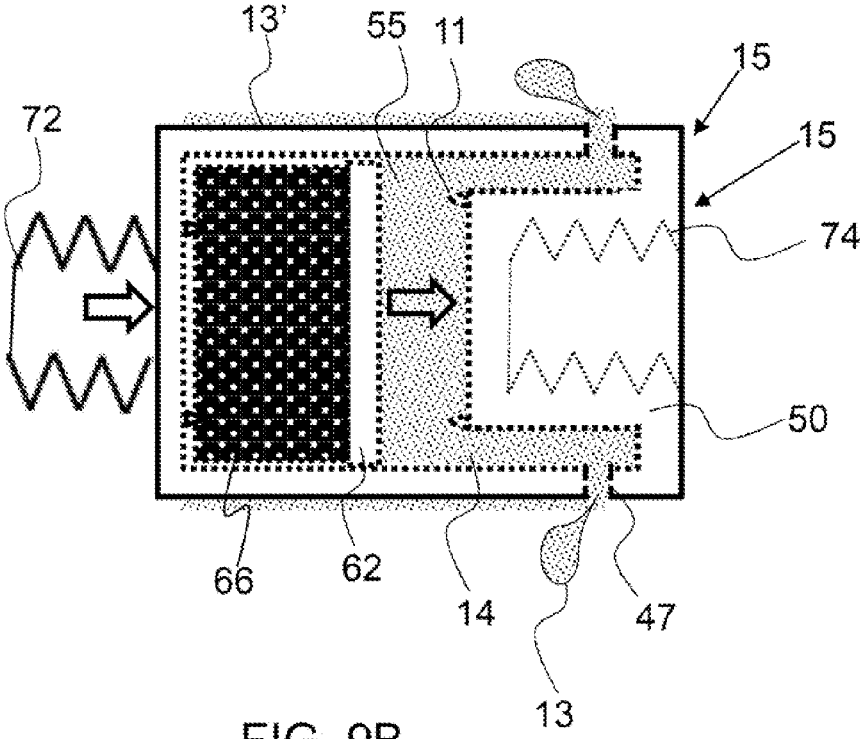

FIG. 9B shows a side view of the exemplary dispensing device of FIG. 9A after the rapid expansion rupture element has been activated.

Figure 10A:
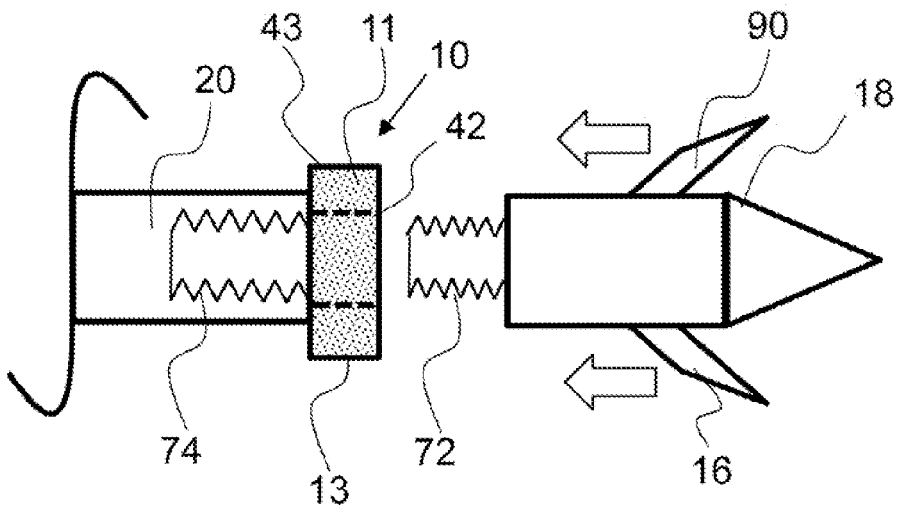

FIG. 10A shows a side view of an exemplary frangible reservoir attached between an arrow shaft and an arrowhead, whereby mechanical blades are configured to rupture the frangible reservoir.

Figure 10B:
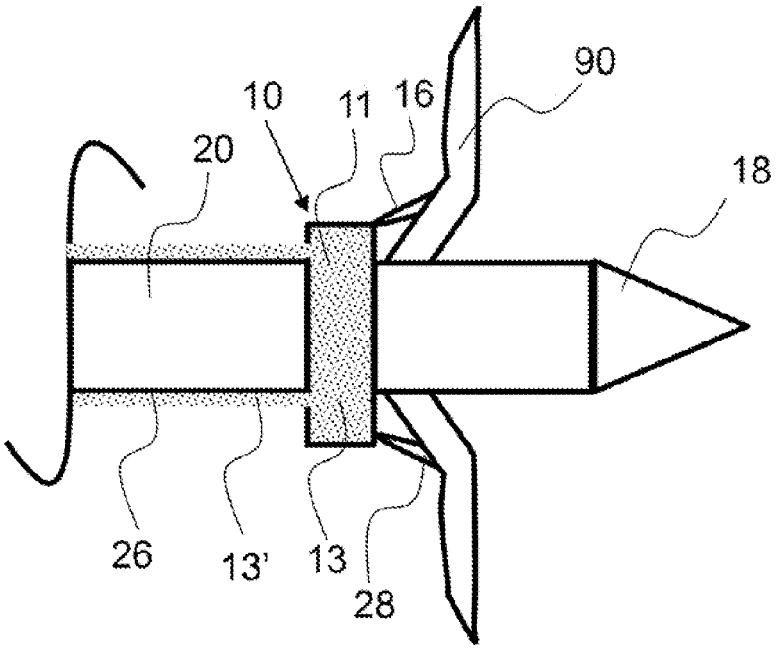

FIG. 10B shows a side view of the exemplary frangible reservoir shown in FIG. 10A after which the mechanical blades actuated open and back and ruptured the frangible reservoir.

Figure 11:
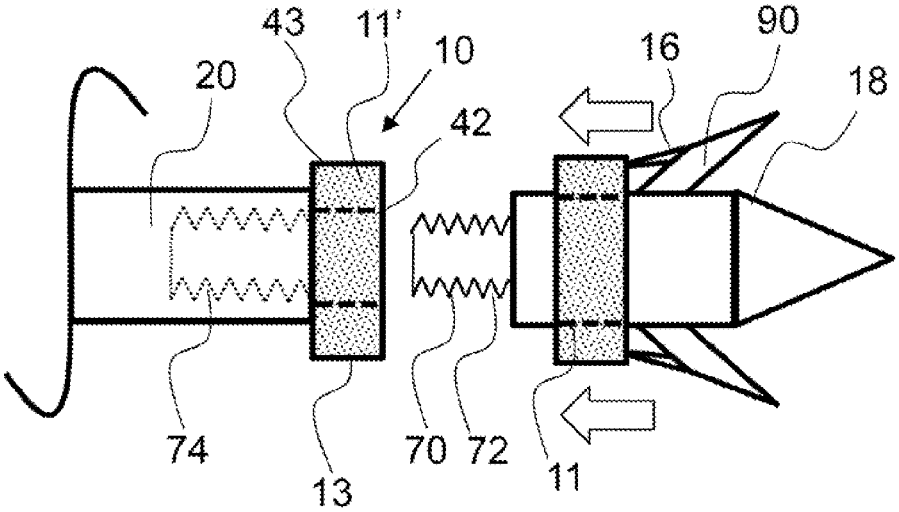

FIG. 11 shows a side view of an exemplary frangible reservoir configured to hold the mechanical blades in a recessed position and a second frangible reservoir configured around an arrow shaft.

Figure 12:
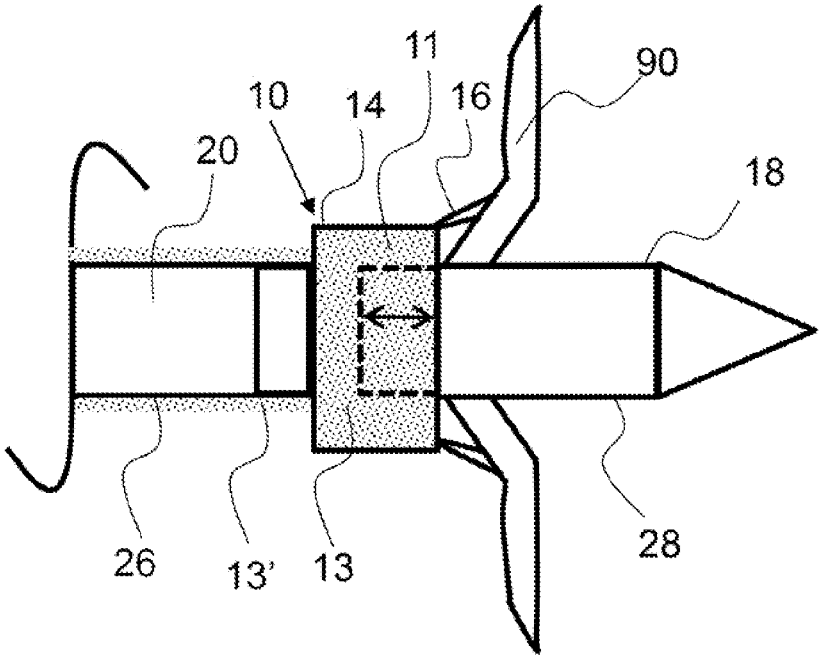

FIG. 12 shows a side view of an exemplary frangible reservoir that extends up along an arrowhead shaft portion.

Figure 13:
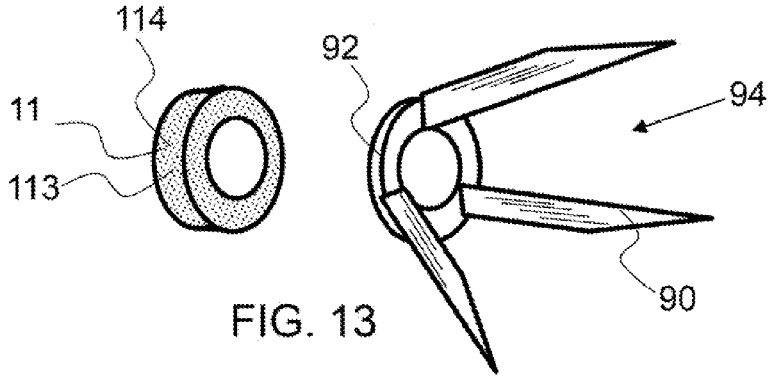

FIG. 13 shows a side view of an exemplary mechanical blade insert and frangible reservoir having a tracking material contained therein.

Figure 14A:
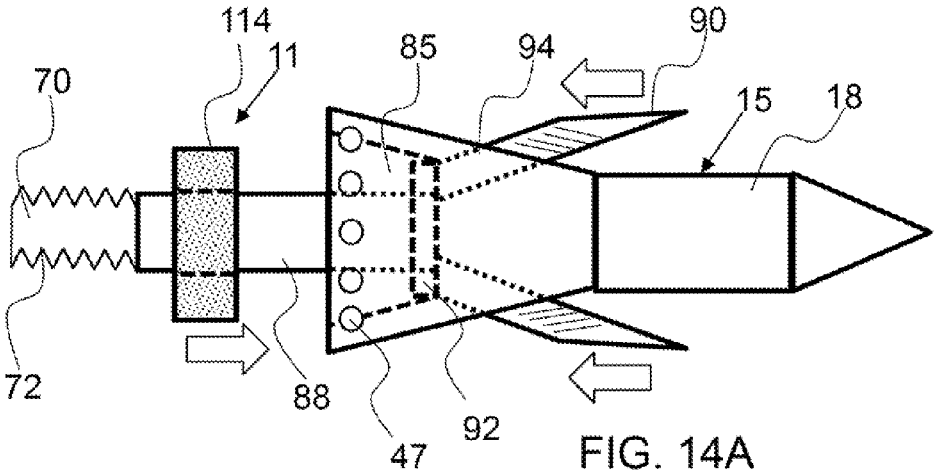

FIG. 14A shows a side view of an exemplary frangible reservoir configured on a coupling shaft portion of an arrowhead.

Figure 14B:
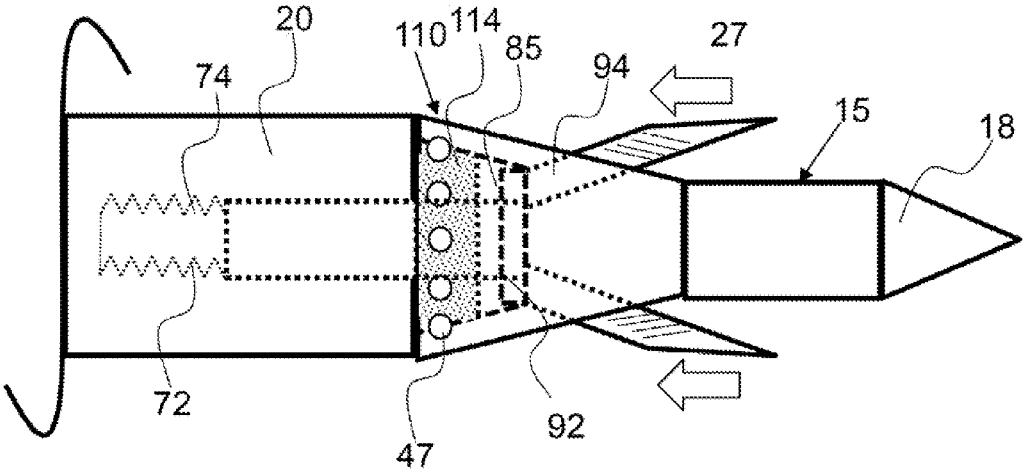

FIG. 14B shows a side view of the exemplary frangible reservoir, shown in FIG. 14A, configured within an arrowhead cavity with the mechanical blade insert shown in FIG. 13 also coupled to the arrowhead.

Figure 14C:
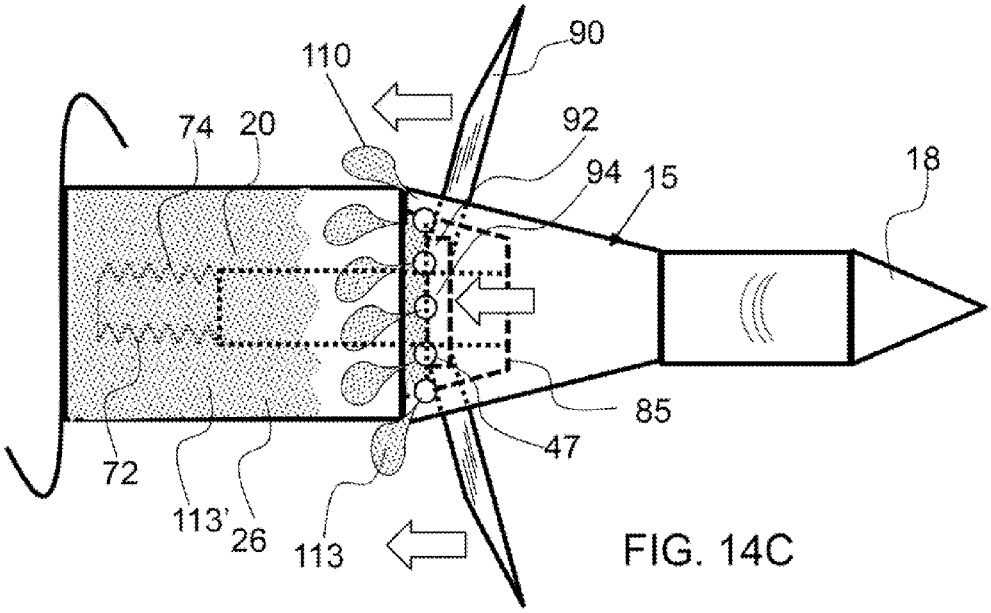

FIG. 14C shows a side view of the exemplary frangible reservoir shown in FIG. 14B being ruptured by the mechanical blade insert.

Figure 15:
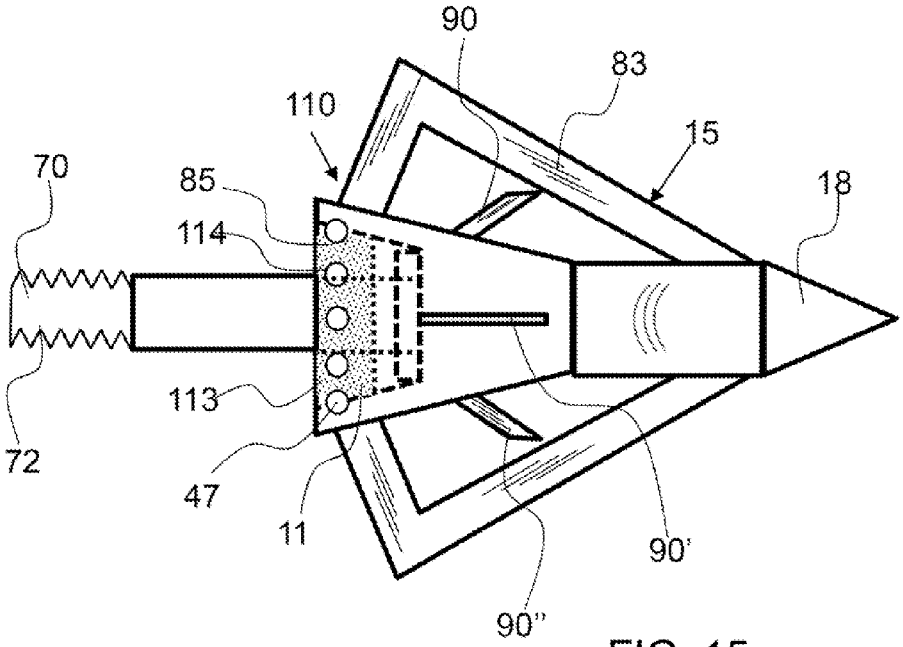

FIG. 15 shows a side view of an exemplary dispensing device comprising an arrowhead and a frangible reservoir within a cavity of the arrowhead.

Figure 16:
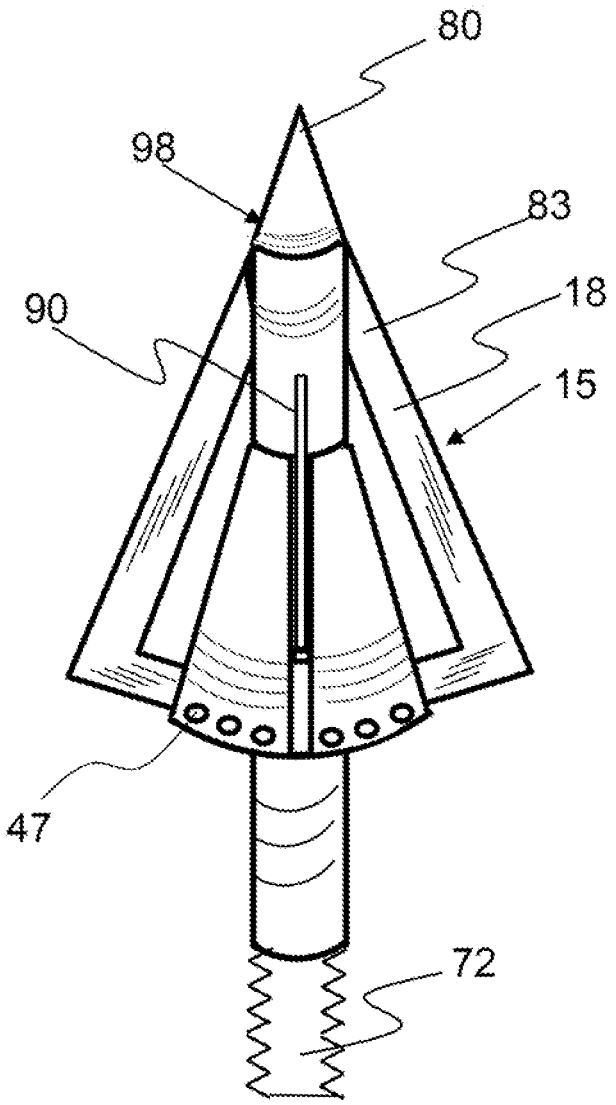

FIG. 16 shows an isometric view of an exemplary dispensing device comprising an arrowhead and a frangible reservoir therein.

Figure 17:
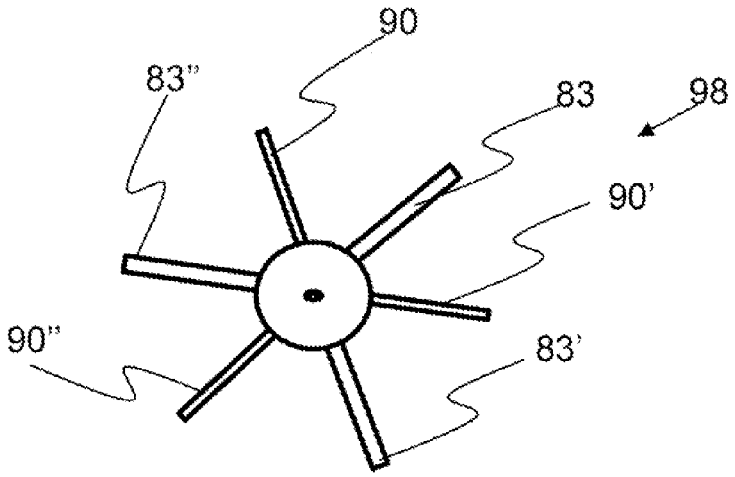

FIG. 17 shows a top down view of an exemplary combination arrowhead having both mechanical and fixed blades.

Figure 18:
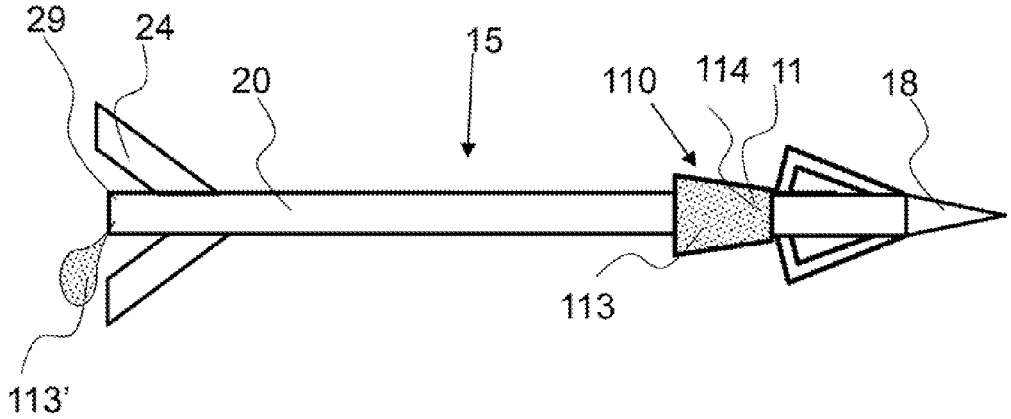

FIG. 18 shows a side view of an exemplary dispensing device comprising a frangible reservoir configured on the arrowhead end of an arrow shaft and tracking material being dispensed from the fletch end of the arrow.

Figure 19:
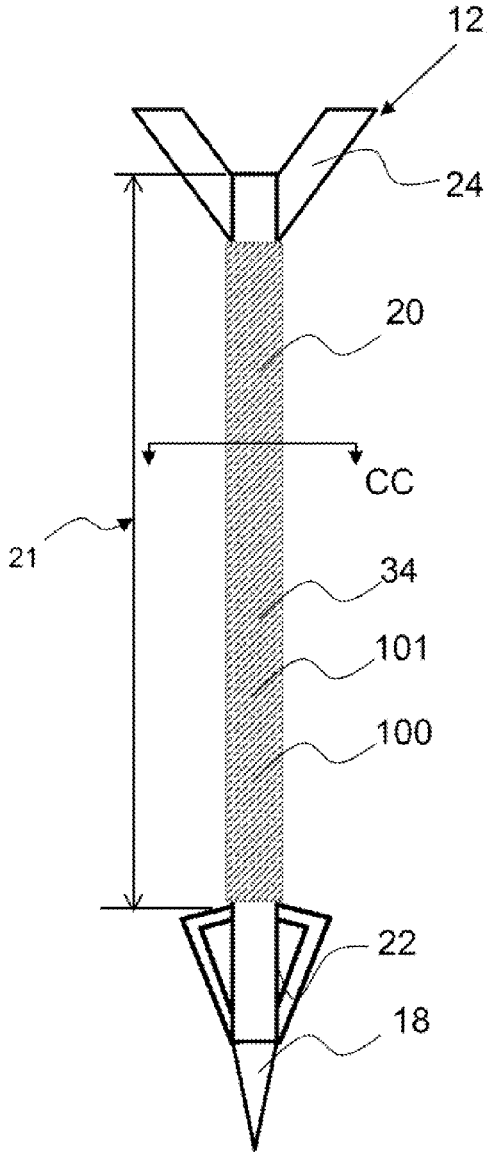

FIG. 19 shows a side view of an exemplary arrow having a low friction sleeve over substantially the entire arrow shaft.

Figure 20:
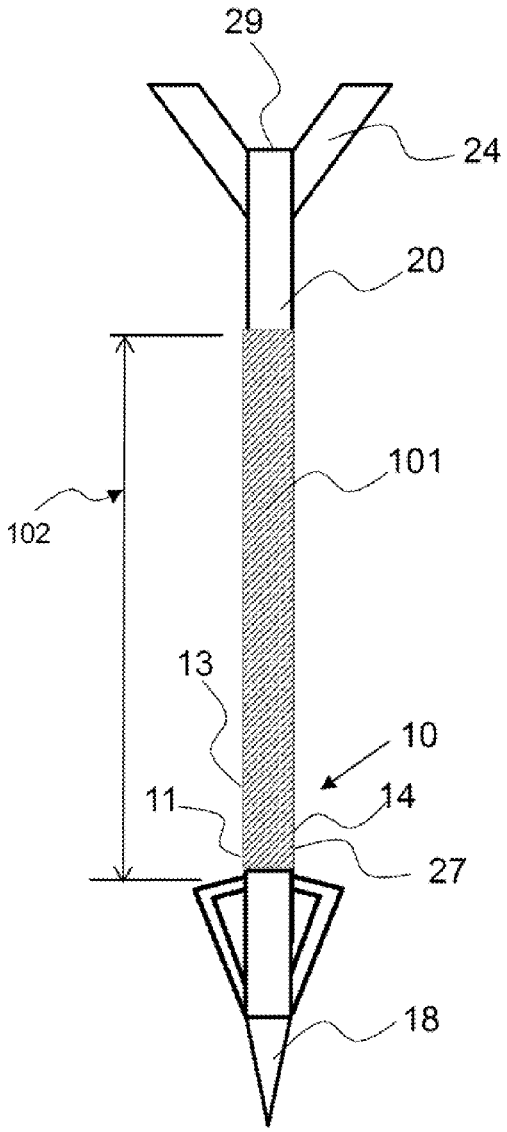

FIG. 20 shows a side view of an exemplary arrow having a low friction sleeve over a portion of the length of the arrow shaft.

Figure 21:
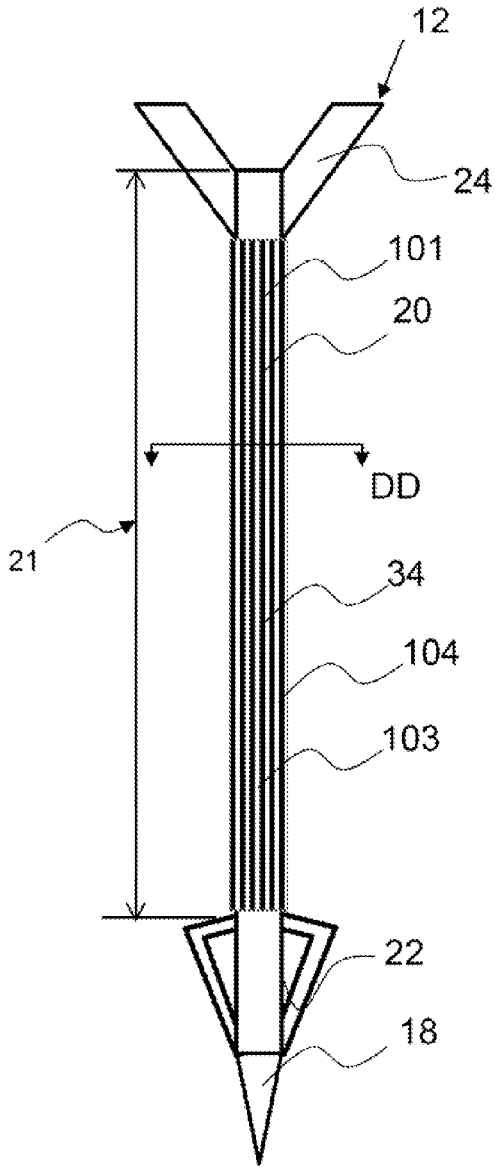

FIG. 21 shows a side view of an exemplary arrow having a low friction sleeve having ridges.

Figure 22:
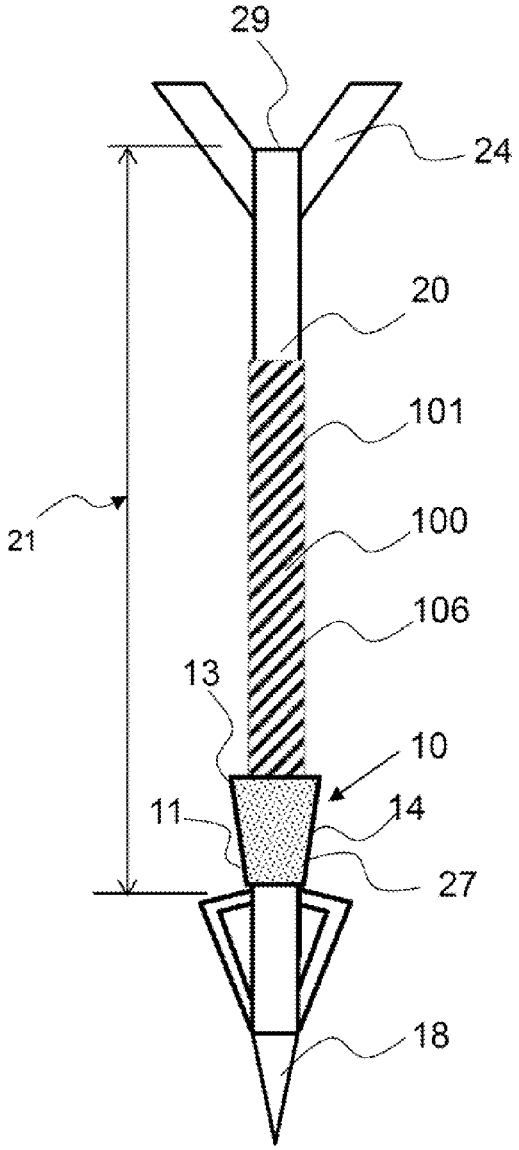

FIG. 22 shows a side view of an exemplary arrow having a low friction sleeve having spiral ridges.

Figure 23:
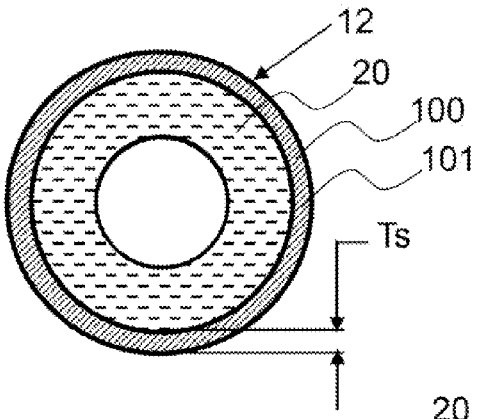

FIG. 23 shows a cross-section view of the exemplary arrow shown in FIG. 19 along line CC.

Figure 24:
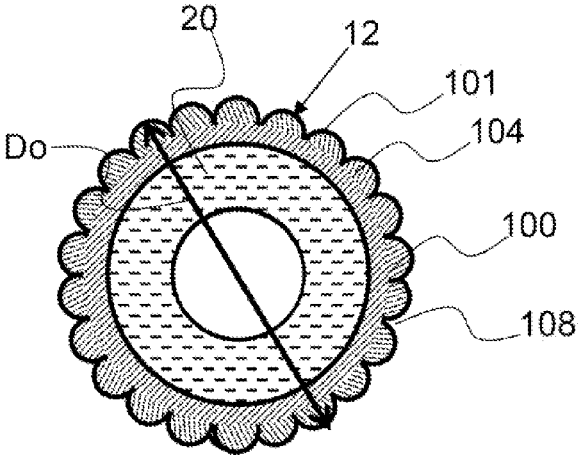

FIG. 24 shows a cross-section view of the exemplary arrow shown in FIG. 21 along line DD.

Figure 25:
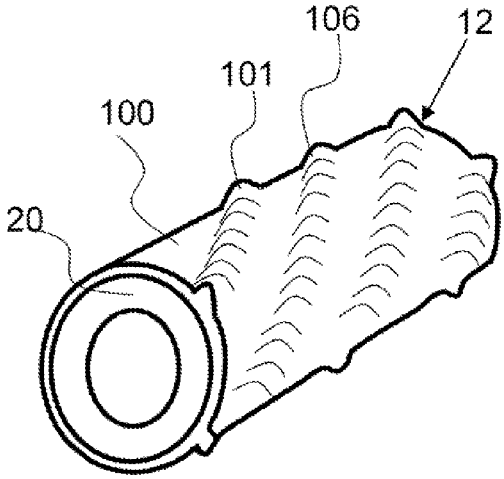

FIG. 25 shows an isometric view of a portion of an exemplary arrow shaft having spiral ridges.

Figure 26:
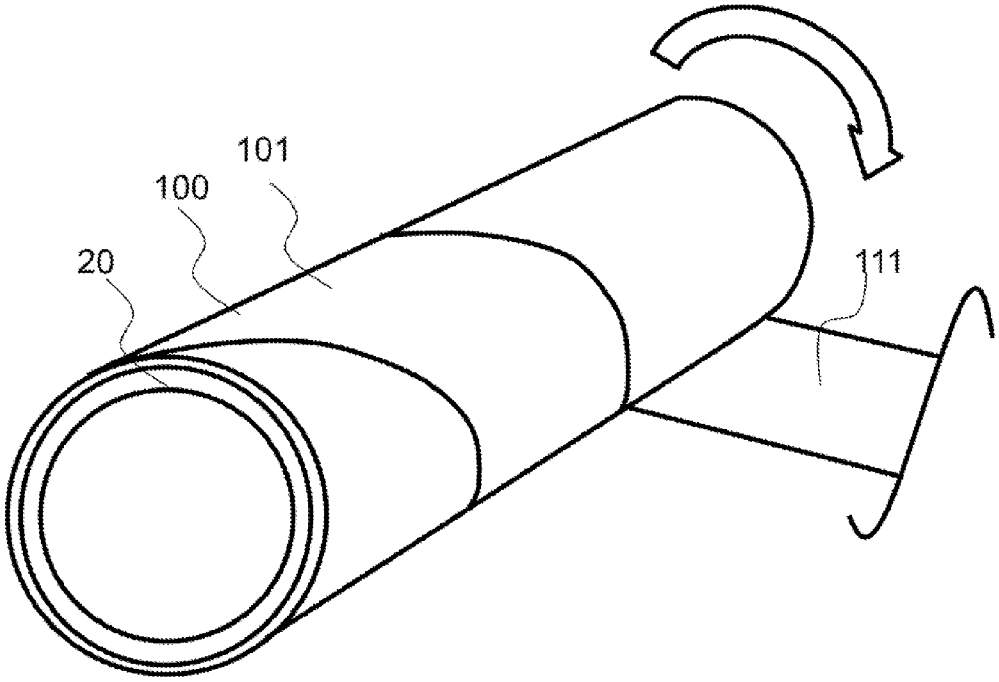

FIG. 26 shows an isometric view of a portion of an exemplary arrow shaft having a low friction tape being spirally wrapped around the shaft to create a low friction sleeve.

It is to be understood that any suitable combinations of dispensing devices and frangible reservoirs may be incorporated into an arrow. For example, a lubricating dispensing device may be configured in an arrowhead, as shown in FIG.

14, and a tracking dispensing device or frangible reservoir may be configured along the arrow shaft near the fletch end of the arrow shaft.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown in FIG. 1, an exemplary arrow 12 comprises a lubricant coating 34 on the arrow shaft 20. In an exemplary embodiment, the lubricant coating 34 is a transition lubricant 32 that is substantially dry on the arrow shaft. The lubricant is coated over substantially the entire length 21 of the arrow shaft and not over the portion where the fletches 24 are configured.

As shown in FIG. 2, an exemplary frangible reservoir 11 is configured on an arrow shaft 20. The frangible reservoir 11 comprises a lubricant 13. The frangible reservoir is a lubricant reservoir 14 configured between the arrowhead 18 and the arrow shaft 20 at the arrowhead end 27 of the arrow shaft. Fletches 24 are configured on the fletch end 29 of the arrow shaft 20. The frangible reservoir 11 is configured at the arrow head end 27 of the shaft but may be configured in any suitable location along the length 21 of the arrow shaft 20.

As shown in FIGS. 3A and 3B, an exemplary lubricating arrow device 10 comprises a frangible lubricating reservoir 14 configured between an arrow shaft 20 and an arrowhead 18. The frangible reservoir 11 has an opening 41 allowing for the insertion of the male threaded portion of the arrowhead. The shaft 20 has a female threaded portion 74, for receiving the arrowhead as shown in FIG. 3B, where the arrowhead is coupled to the arrow shaft. As shown in FIG. 3B the frangible reservoir is coupled and retained between the arrow shaft 20 and arrowhead 18. The frangible reservoir has an outside diameter 43 that is larger than the outside diameter of the arrow shaft 22. The inner diameter 42 of the ring shaped frangible reservoir 40 is configured to allow the male threaded portion 72 to extend therethrough.

As shown in FIG. 4 an exemplary dispensing device 15 comprises a frangible reservoir 11 and rupture element 16. The lubricating arrow device 10 comprises a ring shaped dispensing reservoir 40 having an opening 41 therethrough that is configured over a portion of the dispenser body 50. The dispensing device may have an extension, whereby a frangible reservoir may be slid over, as shown. This type of dispensing device may be re-usable whereby replacement frangible reservoirs may be attached. The dispenser body 50 comprises an opening whereby it may be slid over an arrow shaft or portion of an arrowhead, for example.

As shown in FIG. 5, an exemplary dispensing device 15 comprises a frangible reservoir 11 configured in a recess 52 of the dispenser body 50. The dispenser body is generally cylindrical with a recess, much like an O-ring groove, whereby a toroid shaped frangible reservoir 11 is configured therein. The frangible reservoir is larger in diameter than the outer diameter of the arrow shaft 22. The dispensing device 15 is configured to be coupled between the arrow shaft 20 and arrowhead 18 and comprises a male thread portion 72 extending from the dispenser body 50 and a female thread portion 74 configured on the opposite end of the dispenser body. The male thread portion 72 is configured to screw into the female thread portion 74' of the arrow shaft and the male thread portion 72' of the arrowhead is configured screw into the female thread portion 74 of the dispenser body 50. FIG. 5 shows a lubricant 13 contained with the frangible reservoir, however a tracking material or combination of lubricant and tracking material could be contained within the frangible reservoir, as desired. In addition, a dispensing device as shown in FIG. 4 may be configured with a recess 52 as shown in FIG. 5. Any suitable combination of elements and components shown in the figures may be combined into a dispensing device.

As shown in FIG. 6, an exemplary dispensing device 15 comprises a frangible reservoir 11 configured around a device body 50. As shown exemplary rupture elements 16 are configured to press into the frangible reservoir when the arrow enters an object. The compressive force of the object entered by the arrow will push and squeeze the rupture elements into the frangible reservoir. The frangible reservoir shown in FIG. 6 is a ring shaped reservoir and a recess 52 in the dispenser body allows the frangible reservoir to be substantially flush with the outer diameter 53 of the dispenser body. The rupture elements 16 comprise tabs that extend out and comprise a piercing portion 60. When the arrow enters an object, the tabs will be pushed down quickly and this motion will cause the piercing portions 60 to puncture the frangible reservoir 11. Any number and configuration of tabs may be configured around the perimeter of the dispensing device or frangible reservoir. The dispensing devices shown in FIGS. 5-7 have a first threaded portion 44 for coupling with the arrow shaft and a second threaded portion 45 for coupling with the arrowhead. It is envisioned that a new frangible reservoir may be slid over the dispensing devices shown in FIG. 5 and FIG. 6. Frangible reservoirs containing different compositions of lubricant, tracking material and combinations thereof may be selected and configured on or within the dispensing devices shown throughout the figures.

As shown in FIG. 7, an exemplary dispensing device 15 comprises a frangible reservoir 11 within a cavity 55 of the dispenser body 50 and exemplary rupture elements 16 having piercing portions 60 configured over a reservoir seal 46. The frangible reservoir shown in FIG. 7 comprises a cavity and a frangible seal over said cavity. As described in FIG. 6, the rupture element may rupture the seals 46 thereby allowing the lubricant 13 to be dispensed. It is envisioned that this type of dispensing device may be refilled with lubricant, tracking fluid or a combination thereof and a new seal may be attached over the opening to the cavity. It is to be understood that any number of rupture elements may be configured around the perimeter of the dispensing device, as shown in FIG. 7.

As shown in FIG. 8A, an exemplary dispensing device 15 comprises a frangible reservoir 11 within a cavity 55 of the dispenser body 50 and a rupture element 16 within the same cavity. The rupture element shown comprises a piercing portion 60 that is configured to pierce the frangible reservoir when the arrow is shot. As indicated by the large arrow extending from the frangible reservoir, the frangible reservoir will be forced toward the piercing portions when the arrow is shot due to the acceleration of the arrow from the bow. A release port 47, or opening in the dispenser body 50, is configured to allow the contents within the frangible reservoir to be dispensed. Any number of release ports may be configured in the dispenser body.

As shown in FIG. 8B, an exemplary dispensing device 15 comprises a frangible reservoir 11 within a dispenser body 50 cavity 55 and a rupture element 16 within the same cavity. In this embodiment, the rupture element 16, having a piercing portion 60, is configured to rupture the frangible reservoir when the arrow hits an object. As indicated by the arrow in the frangible reservoir, the frangible reservoir will move forward when an arrow strikes an object. In FIGS. 8A and 8B, the frangible reservoir is configured to move or slide within the cavity. It is to be understood that the rupture element may be configured to slide and the frangible reservoir may be configured to remain stationary. A rupture element may comprise a higher density body that is better suited for displacement from acceleration or deceleration.

As shown in FIG. 9A, an exemplary dispensing device 15 comprises a frangible reservoir 11 within a cavity 55 and a rapid expansion type 64 rupture element within the same cavity. The rapid expansion type 64 rupture element comprises a first rapid expansion chemistry 66, and a second rapid expansion chemistry 66', whereby when these two chemistries mix, they react violently and expand. The expansion of the rapid expansion chemistry causes the piston 62 to move toward the frangible reservoir 11 and rupture it. A plurality of piercing portions 60 are configured to rupture the frangible reservoir. It is to be understood that a rapid expansion type rupture element may burst a frangible reservoir alone, without the addition of a piercing portion.

As shown in FIG. 9B, the exemplary dispensing device 15 of FIG. 9A is dispensing lubricant through a plurality of release ports 47. The piston 62 has compresses the lubricant 13 which forces the lubricant out of the release ports. Again, the dispensing device shown in FIGS. 9A and 9B is shown with lubricant 13, however, a tracking material or combination of tracking material and lubricant may be contained in the frangible reservoir.

As shown in FIG. 10A, an exemplary frangible reservoir 11 may be attached between an arrow shaft 20 and an arrowhead 18, whereby mechanical blades 90 are configured to rupture the frangible reservoir.

As shown in FIG. 10B the exemplary frangible reservoir 11 shown in FIG. 10A is being ruptured by the mechanical blades 90 that are actuated back and are hitting the frangible reservoir. The lubricant 13' has been coated on the outside surface 26 of the arrow shaft 20.

As shown in FIG. 11, an exemplary frangible reservoir 11 is configured to hold the mechanical blades 90 in a forward or closed position. In this configuration, the mechanical blades rupture the frangible reservoir as they are forced back and into an open orientation upon entry into a target or object.

As shown in FIG. 12, an exemplary frangible reservoir 11 extends up along an arrowhead shaft portion 28 as indicated by the double arrow. A frangible reservoir that extends up along the arrowhead may be in a better position for being ruptured by the mechanical blades 90. A frangible reservoir may be attached to an arrowhead only, and not extend down over the arrow shaft.

As shown in FIG. 13, an exemplary mechanical blade insert 94 comprises a plurality of mechanical blades 90 and an insert disc 92. Any number of mechanical blades may be configured on a mechanical blade insert including, but not limited to one, two or more, three or more and the like. Also shown in FIG. 13 is a ring shaped frangible reservoir 11 comprising a tracking material 114. The tracking reservoir 114 is configured for insertion over an arrow shaft including the arrow shaft itself or a portion of an arrowhead.

As shown in FIG. 14A, an exemplary frangible reservoir 11 is configured on the arrowhead coupling portion 88 of an arrowhead 18. The tracking reservoir 114 may be slid up into the arrowhead cavity 85.

As shown in FIG. 14B, the dispensing device 15, shown in FIG. 14A, is coupled with an arrow shaft 20. The frangible reservoir is trapped within the cavity 85 downstream of the mechanical blade insert disc 92.

As shown in FIG. 14C, the exemplary frangible reservoir 11, shown in FIG. 14B, is being ruptured by the mechanical blade insert 94 and particularly the insert disc 92. As the mechanical blades 90 are being forced down, as indicated by the large arrows, the insert disc 92 is compressing the frangible reservoir and forcing the tracking material 113 out of the release ports 47. The tracking material 113', such as florescent material, or solution, has coated the outside surface 26 of the arrow shaft 20. An insert disc may comprise one or more piercing portions.

As shown in FIG. 15, an exemplary tracking arrow device 110 comprises an arrowhead and a frangible reservoir 11 within a cavity of the arrowhead 18. The frangible reservoir comprises a tracking material 113.

It is to be understood that the dispensing devices 15, shown in FIGS. 14-15 could contain a lubricant and/or a tracking material.

As shown in FIG. 16, an exemplary dispensing device 15 comprises an arrowhead 18 and a frangible reservoir therein (not shown). FIG. 16 shows that an arrowhead may be a dispensing device and may comprise a detachable frangible reservoir that may be replaced after use. Also shown in FIG. 16, is an arrowhead comprising both fixed 83 and mechanical blades 90, or a combination arrowhead 98.

FIG. 17 shows a top down view of an exemplary combination arrowhead 98 having both mechanical blades 90, 90' and 90" and fixed blades 83, 83' and 83". Any suitable number and configuration of blade types may be incorporated into an arrowhead and into an arrowhead having a frangible reservoir therein, or thereon.

As shown in FIG. 18, an exemplary dispensing device 15 comprises a frangible reservoir 11 configured on the arrowhead end of an arrow shaft 20 and tracking material 113' being dispensed from the fletch end 29 of the arrow. The tracking reservoir 114, comprising tracking material 113, is configured to dispense the tracking material into the interior of the arrow shaft 20 and out the fletch end 29. An animal hit with an arrow may carry the arrow with them until they collapse. The florescent material dripping out of the end of the arrow may provide for easier tracking. Release ports may be configured on the inside of the frangible reservoir, and the outside may not be frangible, thereby allowing the contents therein to be squeezed out into the interior of the arrow shaft.

As shown in FIG. 19, an exemplary arrow 12 has a low friction sleeve 100 over substantially the entire arrow shaft 20. The low friction material 101, or sleeve, is configured over substantially the entire length of the arrow shaft 21 and in some embodiments may extend the entire length of the arrow shaft.

As shown in FIG. 20, an exemplary arrow 12 has a low friction material 101 over a portion of the length of the arrow shaft 20, and extends a length 102. The low friction material shown in FIG. 20 may be a chemical vapor deposited parylene having a thickness of 2 um or less.

As shown in FIG. 21, an exemplary arrow 12 has a low friction thermal shrink tube 103 having ridges 104. The ridges are raised portions of the low friction material and extend substantially along the length of the shaft 20. The ridges may be any suitable size and may extend up from the surface of the shaft and/or low friction material any suitable distance. In addition, any suitable number of ridges may be configured around the circumference of the arrow shaft including, but not limited to, two or more, three or more, five or more, ten or more, twenty or more, fifty or more and any range between and including the values provided.

As shown in FIG. 22, an exemplary arrow 12 has a low friction sleeve 100 having spiral ridges 106. The spiral ridges extend around the circumference of the shaft and down along the length. Again, any number of spiral ridges may be configured into a low friction material 101. In addition, the angle of the spiral ridges may be configured to improve the flight of the arrow.

FIG. 23 shows the cross-section of the exemplary arrow shown in FIG. 19 along line CC, wherein a low friction material 101, in the form of a shrink tube sleeve, is attached to the shaft 20. The thickness of the sleeve 100 is shown as Ts.

As shown in FIG. 24, the cross-section of the exemplary arrow shown in FIG. 19 along line DD, a low friction material 101, in the form of a sleeve 100, comprises ridges 104 that extend down along the length of the shaft. The ridges reduce the outer surface area, or the outer contact area along diameter $D_o$, as shown. A total of 22 ridges are configured around the circumference of the arrow shaft 20.

As shown in FIG. 25, an exemplary arrow shaft 20 has spiral ridges 106 in a low friction sleeve 100. The spiral ridges extend around the circumference of the shaft and down the length of the shaft simultaneously.

As shown in FIG. 26, an exemplary arrow shaft 20 has a low friction tape 111 being spirally wrapped around the shaft to create a low friction sleeve 100. The low friction material may be a fluoropolymer tape, and may include an adhesive on one side to bond to the shaft.

Example 1

Transitional Lubrication Friction Test

Four 30 inch long carbon arrow shafts, from Carbon Express having a diameter of approximately 0.30 in, were tested for friction force using a Harland Medical Systems Inc, Eden Prairie, Minn., FTS5100 Friction Tester. Two of the arrows were coated with a transitional lubricant comprising a polyurethane based hydrogel. The arrow shafts were tested for friction force by placing them between the 80 Shore A durometer silicone clamps with a 500 gram clamp force and pulling them at a rate of 1 cm/second with an acceleration of 0.2 cm/s$^2$. A 10 cm length was pulled through the clamps and the force was measured. Two shafts were tested without any transitional coating and they had a 10 g and 12 g peak force. One of the transitional lubricant coated shafts was wet with water, to activate the lubricant, and then allowed to sit at room temperature for three minutes to dry. The peak force for this arrow shaft was 8 g. A second coated arrow shaft was allowed to dry for six minutes and it also had peak force of 8 g. The uncoated arrow shafts had a 25% and 50% increase in peak friction force. This is a substantial increase and, as described herein, may limit the penetration depth of the arrow shaft into an animal.

It is to be understood that any of the dispensing devices and frangible reservoirs described herein, including those shown throughout the figures, can be configured with a lubricant, a tracking material or a combination of materials. In addition, any suitable combination of components, as shown throughout the figures, may be configured into a dispensing device.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. An arrow comprising:

a) an arrow shaft having a length;

b) a plurality of fletches;

c) a transition lubricant coating over a substantially portion of the length of said arrow shaft to provide a lubricant coated shaft, wherein the transition lubricant is configured along the length of the shaft from an arrowhead end to the plurality of fletches;

wherein the transition lubricant is a hydrogel comprising a interpenetrating network of polymer chains that are hydrophilic and dry;

whereby the transition lubricant is activated by contact with a fluid, wherein said lubricant coated shaft portion has a first dry state and a first coefficient of friction prior to contact with said fluid and a second activated state and a second coefficient of friction after contact with said fluid that is one half or less the first coefficient of friction.

2. The arrow of claim 1, wherein the transition lubricant is hydroscopic.

3. The arrow of claim 1, wherein the transition lubricant is a hydrogel consisting essentially of polyurethane polymers.

4. The arrow of claim 1, wherein the transition lubricant is a cross-linked network of polymer chains.

5. The arrow of claim 1, wherein the fluid is a bodily fluid.

6. The arrow of claim 1, wherein the transition lubricant coating is configured substantially over an entire outside surface of the arrow shaft length.

7. The arrow of claim 1, wherein the transition lubricant is a hydrogel consisting essentially of poly(vinyl alcohol) PVA polymers.

* * * * *